US009233413B2

(12) United States Patent
Zhang

(10) Patent No.: US 9,233,413 B2
(45) Date of Patent: Jan. 12, 2016

(54) ROLLING FORMING METHOD OF WHEEL DISC

(75) Inventor: Xingyuan Zhang, Shanghai (CN)

(73) Assignee: SHANGHAI XINGPU SPINFORMING WHEEL CO., LTD., Shanghai (CN)

( * ) Notice: Subject to any disclaimer, the term of this patent is extended or adjusted under 35 U.S.C. 154(b) by 867 days.

(21) Appl. No.: 13/387,648

(22) PCT Filed: Jul. 27, 2010

(86) PCT No.: PCT/CN2010/075495

§ 371 (c)(1),
(2), (4) Date: Jan. 27, 2012

(87) PCT Pub. No.: WO2011/012070

PCT Pub. Date: Feb. 3, 2011

(65) Prior Publication Data

US 2012/0117806 A1 May 17, 2012

(30) Foreign Application Priority Data

Jul. 28, 2009 (CN) ..... 2009 1 0055459

(51) Int. Cl.

| | |
|---|---|
| ***B21D 53/30*** | (2006.01) |
| ***B21D 53/26*** | (2006.01) |
| ***B21D 22/16*** | (2006.01) |

(52) U.S. Cl.

CPC ..... *B21D 53/30* (2013.01); *B21D 22/16* (2013.01); *B21D 53/264* (2013.01); *Y10T 29/49531* (2015.01)

(58) Field of Classification Search

CPC ..... B21K 1/38; B21D 53/26; B21H 1/10; Y10T 29/5174; Y10T 29/5129; Y10T 29/49481; Y10T 29/49504

See application file for complete search history.

(56) References Cited

U.S. PATENT DOCUMENTS

2003/0217578 A1* 11/2003 Mustread et al. ..... 72/101

FOREIGN PATENT DOCUMENTS

| | | | |
|---|---|---|---|
| CN | 1491758 | A | 4/2004 |
| CN | 1744997 | A | 3/2006 |
| CN | 101020286 | A | 8/2007 |
| CN | 101147951 | A | 3/2008 |
| CN | 101269456 | A | 9/2008 |
| JP | 2000225432 | A | 8/2000 |
| WO | 9625257 | A1 | 8/1996 |

* cited by examiner

*Primary Examiner* — Moshe Wilensky
(74) *Attorney, Agent, or Firm* — Hahn & Voight PLLC; Roger C. Hahn

(57) ABSTRACT

The invention provides a rolling forming method of wheel disc, which comprises the following steps: (1) Baiting a circular blank; (2) placing the circular blank in a cavity of a rolling explorator and adopting at least two rolling wheels symmetrically arranged along the circumferential direction of the rolling explorator to perform planar synchronous staggered rolling on the circular blank in the cavity of the rolling explorator; (3) performing trimming and sizing; and (4) stretch forming. The rolling forming method of wheel disc of this invention can precisely form various geometric sections with gradual deformation. The formed product has a uniform mass in the axial direction and the circumferential direction, and has a high dynamic balance precision. The invention can make the blank deform precisely, enhance the production efficiency, and reduce the cost, therefore the invention has good application and popularization prospect.

20 Claims, 8 Drawing Sheets

ROLLING FORMING METHOD OF WHEEL DISC

This application is a national stage application of international application number PCT/CN2010/075495, filed on Jul. 27, 2010, claiming priority to Chinese application number CN 200910055459.0, filed on Jul. 28, 2009.

FIELD OF THE INVENTION

The invention relates to the field of wheel processing technique, and particularly relates to a rolling forming method of wheel disc.

BACKGROUND OF THE INVENTION

In prior art, the CNC (Computerized Numerical Control) spinning forming method is widely used to form the truck wheel discs at home and abroad, The method spins an equal-thickness blank into an equal-strength section with gradually reduced thickness. The technological process of spinning forming method is as shown in FIG. 1:

a. Baiting a circular blank and punching a positioning hole for spinning.

b. Spinning the blank into a wheel disc by the CNC spinning forming method on a tapered circular cylinder exploratory so as to meet the requirements of forming an equal-strength section which gradually becomes thinner.

c. Processing the excircle and the end surface of the spinning formed wheel disc in a dedicated vertical lathe in order to meet the requirement on the tolerance of the outer diameter and the requirement that the height of the wheel disc should be uniform. (This step aims at to attain the dimensional precision requirement of products, which the spin-forming technology can not achieve).

d. Punching a center hole and screw holes.

e. Punching hand holes (air holes) and then extruding the hand holes (air holes).

f. Reaming the spherical surfaces of the screw holes (or extruding the spherical surfaces of the screw holes).

g. Turning the center hole (or extruding the center hole).

h. Reshaping the flat surface and unifying the geometrical shape (for avoiding the out-of-roundness of the single air hole caused by irregular deformation during punching).

As shown in FIG. 2 and FIG. 3, the existing spinning technology performs spinning on a work piece (circular blank) R with a spinning wheel P. The larger the spinning angle ($\alpha 1+\alpha 2$) of the spinning technology, the larger the spinning gripping angle ($\alpha 3+\alpha 4$) of the spinning wheel. Furthermore, the smaller the gripping angle, the stronger the extrusion force, therefore the extrusion force of the existing spinning technology is smaller. In addition, because the spinning explorator Q is cylindrical, and the forming method on the spinning explorator Q is an open type forming way without deformation size limitations, the well extrusion effect can not be achieved. Besides, fewer limitations on the spinning forming method and nonuniformity of the materials will result in instability of the spinning wheel P along with the changes in resistance during the movements of spinning wheel P, which cause small deformation on hard portion of the material whereas large deformation on soft portion, so micro-uneven conditions in the axial direction and the circumferential direction of the wheel disc will be brought about, and consequently the unbalance of the wheel disc. On the other hand, turning of the excircle will generate turning eccentricity, which can also further increase the unbalance of the wheel disc, as a result the precision of the excircle of the formed product can not meet the matching dimensional precision, and the spinning ring is retained on the formed product, which makes excircle processing in the vertical lathe indispensable. Furthermore, because of the unevenness of the height of formed product due to the material nonuniformity, turning of the end surface is necessary. Thus it can be seen, the only way to improve the spinning efficiency is to increase the number of the vertical lathes and the number of staffs. However, the production cost is also increased.

SUMMARY OF THE INVENTION

The invention aims at providing a rolling forming method of wheel disc for improving the precision, strength and the speed of the disc forming.

The technical principle of the invention is as follows: The inventor invents a rolling forming method of the wheel disc against the defects in the existing spinning forming method of the wheel disc. During the rolling forming process, the compression area of the rolled blank is large and the rolling force is stronger than the existing spinning force. In addition, during the rolling forming process, a rolling explorator plays a role in limiting the outer diameter of the formed disc and the deformation resistance is further generated in order to enable the blank to be extruded and make precise deformation of the blank.

The purpose of the invention is achieved in this way: A rolling forming method of wheel disc comprises the following steps:

(1) Baiting a circular blank;

(2) Placing the circular blank in a cavity of a circular rolling explorator; and adopting at least two rolling wheels symmetrically arranged along the circumferential direction of the rolling explorator to perform planar synchronous staggered rolling on the circular blank in the cavity of the rolling explorator, in order to roll the circular blank into a wheel disc blank which gradually becomes thinner from the center to the rim; (The planar rolling refers to the situation that the rolling trajectories of the rolling wheels are always in a plane. The synchronous rolling refers to the situation that the rolling motions of the at least two rolling wheels are synchronous in order to ensure the uniform quality of the rolled surface of the circular blank. The staggered rolling refers to the situation that the rolling wheels are disposed mutually staggered in their initial positions in order to prevent the rolling trajectories of the rolling wheels on the surface of the circular blank from coinciding to ensure the surface of the circular blank compact. In other words, the more the rolling wheels is disposed, the more compact the rolling traces on the surface of the circular blank become, the better the quality of the surface is achieved. However, the factors of economic cost and stress state should be taken into account while determining the amount of the rolling wheels.)

(3) Performing trimming and sizing on the wheel disc blank;

(4) Stretching the wheel disc blank to form a wheel disc to meet the shape requirements of the section of the wheel disc and the dimensional requirements of the outer diameter and the height of the wheel disc.

Preferably, the rolling motions of the at least two rolling wheels in the step (2) comprise feed motions of the at least two rolling wheels in a horizontal direction and a rotation of each rolling wheel.

Preferably, the feed motion of each rolling wheel in the step (2) is controlled by a rolling wheel feeding mechanism connected with an electric control system, wherein the electric control system controls the feed rate and the feed amount of each rolling wheel feeding mechanism respectively thereby to further control the feed rate and the feed amount of each rolling wheel.

Preferably, the rotation of each rolling wheel in the step (2) is driven by a rolling wheel driving element connected with each rolling wheel respectively. Each rolling wheel driving element is connected with and controlled by an electric control system. The rolling wheel driving element drives each rolling wheel to generate an initial rotational speed respectively so as to prevent the rolling wheel from damage caused by excessive friction force generated between the rolling wheel and the circular blank at the very beginning of rolling. Once the rolling wheel starts to roll the circular blank, the driving force of the rolling wheel will not be supplied by rolling wheel driving element any more, but supplied by the friction force, which causes the servo of rolling wheel generated by rolling contact between the rolling wheel and the circular blank.

Preferably, the rolling forming method of the wheel disc further comprises the step (5): processing a center hole, screw holes, hand holes and the spherical surfaces of the screw holes on the formed wheel disc.

Preferably, the section of the cavity of the rolling explorator adopted in the step (2) is an equal-strength section, and the shape of the cavity of the rolling explorator corresponds to the shape of the wheel disc.

Preferably, in the step (1), the center hole is punched on the circular blank to position the circular blank in the cavity of the rolling explorator after cutting the circular blank.

Preferably, in the step (3), performing trimming and sizing on the wheel disc blank in a blanking method.

Preferably, in the step (4), stretching the wheel disc blank in dwell method in order to make the outer diameter dimension of the formed wheel disc precise.

The step (2) is implemented by a rolling forming machine. The rolling forming machine used for rolling the circular blank comprises:

A frame configured as a support structure of the whole rolling forming machine;

A lower rotating head assembly fixed on the frame; An actuating mechanism of the lower rotating head assembly connected with the lower rotating head assembly;

An electric control system connected with the actuating mechanism of the lower rotating head assembly;

A disc-like rolling explorator, the bottom of which is fixed to the lower rotating head assembly, having a cavity which could be formed into various shapes depending on the shapes of workpieces to be machined;

At least two rolling wheel units symmetrically arranged along the circumferential direction of the rolling explorator, wherein each rolling wheel unit comprises a rolling wheel which performs rolling motions in the cavity; the number of the rolling wheel unit can also be three, four or even more. The symmetrical arrangement of the rolling wheels aims at balancing the unbalanced radial force generated during the rolling deformation process of the workpieces. The symmetrical arrangement can greatly offset the unbalanced deformation force and prolong the service life of the rolling forming machine.

An upper rotating head assembly connected with a feed mechanism of the upper rotating head assembly to compress the rolling explorator under the drive of the feed mechanism of the upper rotating head assembly connected with the electric control system;

At least two rolling wheel feeding mechanisms correspondingly connected with the rolling wheel units and vertically connected with the feed mechanism of the upper rotating head assembly to drive the horizontal synchronous motions of the rolling wheels under the control of the electric control system.

Preferably, each rolling wheel unit is further correspondingly connected with a rolling wheel driving element connected with the electric control system. The purpose of arranging the rolling wheel driving element is to impart an initial rotational speed to the rolling wheel at the beginning of rolling forming in order to avoid damage of the rolling wheel caused by the excessive friction force between the rolling wheel and the workpiece when the rolling wheel enters into the rolling working position.

Preferably, a center hole is arranged at the center of the rolling exploratory and is coupled to the upper rotating head assembly. The center hole is used together with the upper rotating head assembly for positioning role so as to prevent workpiece from slipping in the cavity.

Preferably, the electric control system comprises: A plurality of displacement sensors correspondingly arranged on the feed mechanism of the upper rotating head assembly and each rolling wheel feeding mechanism respectively; A control PLC (programmable logic controller) connected with each displacement sensors respectively for performing data exchange with all of the displacement sensors; A plurality of proportional valves connected with the control PLC and correspondingly connected with the feed mechanism of the upper rotating head assembly and each rolling wheel feeding mechanism respectively for correspondingly controlling the feed rate of the feed mechanism of the upper rotating head assembly and each rolling wheel feeding mechanism respectively.

The electric control system can adjust the feed amount and the feed rate of the upper rotating head assembly depending on the factors such as the thickness of the circular blank in order to ensure the compaction of the circular blank. And the electric control system can further precisely control the horizontal feed rate and the horizontal feed amount of each rolling wheel during the rolling process, in order to control the circular blank to deform steady according to the precision requirements of the product and enable the shape of the formed variable section to meet the requirements of dimensional precision.

Preferably, each rolling wheel unit further comprises: A hollow sliding block correspondingly fixed to each rolling wheel feeding mechanism; A rotating shaft arranged in the hollow sliding block, wherein one end of the rotating shaft is correspondingly connected with each rolling wheel respectively and the other end of the rotating shaft is correspondingly coupled to a rolling wheel motor.

Preferably, a cross beam with at least two horizontally arranged sliding slots is further arranged between the upper rotating head assembly and the feed mechanism of the upper rotating head assembly. The rolling wheel feeding mechanisms are arranged over the cross beam. And the sliding blocks correspondingly slide along the sliding slots. The sliding slots and the corresponding sliding blocks on the cross beam play a well guiding role of the rolling wheels in the horizontal direction in order to enable the horizontal feed trajectories of the rolling wheels to be more precise and more stable.

Preferably, the frame comprises:

A base, on which the lower rotating head assembly is fixedly mounted;

At least four columns symmetrically vertically arranged on the base;

An upper box fixed on the upper ends of all the columns and coupled to the feed mechanism of the upper rotating head assembly.

Preferably, each rolling wheel feeding mechanism comprises:

A hydraulic cylinder fixed to the feed mechanism of the upper rotating head assembly vertically;

A connector with a horizontally arranged threaded hole coupled to a positioning bolt, wherein one end of the connector is fixed to the piston rod of the hydraulic cylinder, the other end of the connector is fixed to each sliding block correspondingly, the threaded hole and the corresponding positioning bolt are used for positioning the horizontal position of the rolling wheel unit.

Preferably, the feed mechanism of the upper rotating head assembly is a hydraulic cylinder assembly, and the actuating mechanism of the lower rotating head assembly is a hydraulic motor.

Preferably, each rolling wheel unit further comprises a spray cooling device which is connected with the electric control system. The spray cooling devices sprays cooling lubricating liquid towards the circular blank and each rolling wheel during the rolling process to avoid heating-up and abrasion of the surfaces of the circular blank and the rolling wheels.

The working process of the rolling forming machine is as follows:

1) Loading: Positioning the circular blank with a punched center hole into the cavity of the rolling explorator.

2) The feed mechanism of the upper rotating head assembly is driving the upper rotating head assembly towards the circular blank in order to compress it and driving the rolling wheel units to descend synchronously under the control of the electric control system.

3) The actuating mechanism of the lower rotating head assembly drives the lower rotating head assembly to rotate and simultaneously drives the rolling explorator and the circular blank to rotate together under the control of the electric control system, thus the upper rotating head assembly rotates together with the circular blank.

4) The rolling wheel driving element imparts an initial rotational speed to each rolling wheel under the control of the electric control system, and the rolling wheel feeding mechanism simultaneously drive each rolling wheel unit to feed horizontally under the control of the electric control system, so as to enable the rolling wheel unit to slowly enter into the space above the circular blank for rolling, wherein the initial feed amounts of the rolling wheels in the horizontal direction are staggered arranged, that is, the initial rolling trajectories of the at least two rolling wheels on the surface of the circular blank are not coincident. However, the feed increments are synchronous and constant during the whole rolling process. Such process will produce a high-quality rolled wheel disc with a fine grained surface.

5) The feed mechanism of the upper rotating head assembly drives the upper rotating head assembly to depart from the wheel disc blank and drive the rolling wheel units to ascend simultaneously under the control of the electric control system. The electric control system further controls the lower rotating head assembly to stop rotating.

The invention of rolling forming method is a planar rolling forming process which refers to the process with little cutting amount or without cutting amount. The circular blank is formed in the cavity of the rolling explorator in the way of rolling and extruding. The shape of the cavity could be various surfaces, for example, a circular plane, a circular inclined plane, a circular corrugated surfaces or a circular wave surface. The workpiece produced by the method is more compact in structure, higher in strength, lighter in weight, lower in material consumption, and lower in energy consumption (energy consumption can be saved by above 80% in comparison with hot die forging). Besides, the production efficiency will be multiplied several times.

Comparing with the prior art, the rolling forming method of wheel disc has advantages and positive effects as follows:

(1) The force acting on the workpiece is stronger and the deformation precision of the workpiece blank is better because the rolling explorator will limit the deformation of the workpiece (different from the open type forming way in a spinning explorator) in the rolling forming process, and then generate a deformation resistance which will extrude the workpiece blank.

(2) The bending fatigue life of the workpiece produced with the same material can be greatly prolonged. The bending fatigue test of the wheel disc has proved that the service life of the workpiece can be prolonged by 30%, and the bending fatigue life of the product rolling formed with the 380 material (380 is the tensile strength of the material) can achieve the bending fatigue life of the product spinning formed with the 420 material (420 is the tensile strength of the material).

(3) The rolling forming method is a kind of coercive forming method, which limits the deformation of the workpiece in large scale. The invention can precisely form various geometric sections with the gradual deformation depending on the shape of the cavity of the rolling explorator. The formed product has a uniform mass in the axial direction and the circumferential direction, and has a high dynamic balance precision.

(4) The invention can produce a workpiece with high forming precision, therefore after the rolling step, just stamping, trimming and forming steps need to be performed to meet the 5 precision requirements of outer circle and the height of the end surface of the workpiece. And because the stamping rate and the stamping efficiency are much higher than the existing turning rate and turning efficiency, the invention will greatly improve the production efficiency.

BRIEF DESCRIPTION OF THE DRAWINGS

The following figures is used for explain the invention in detail with corresponding embodiment.

NUMERAL REFERENCES

P spinning wheel

Q spinning explorator

Figure 1:
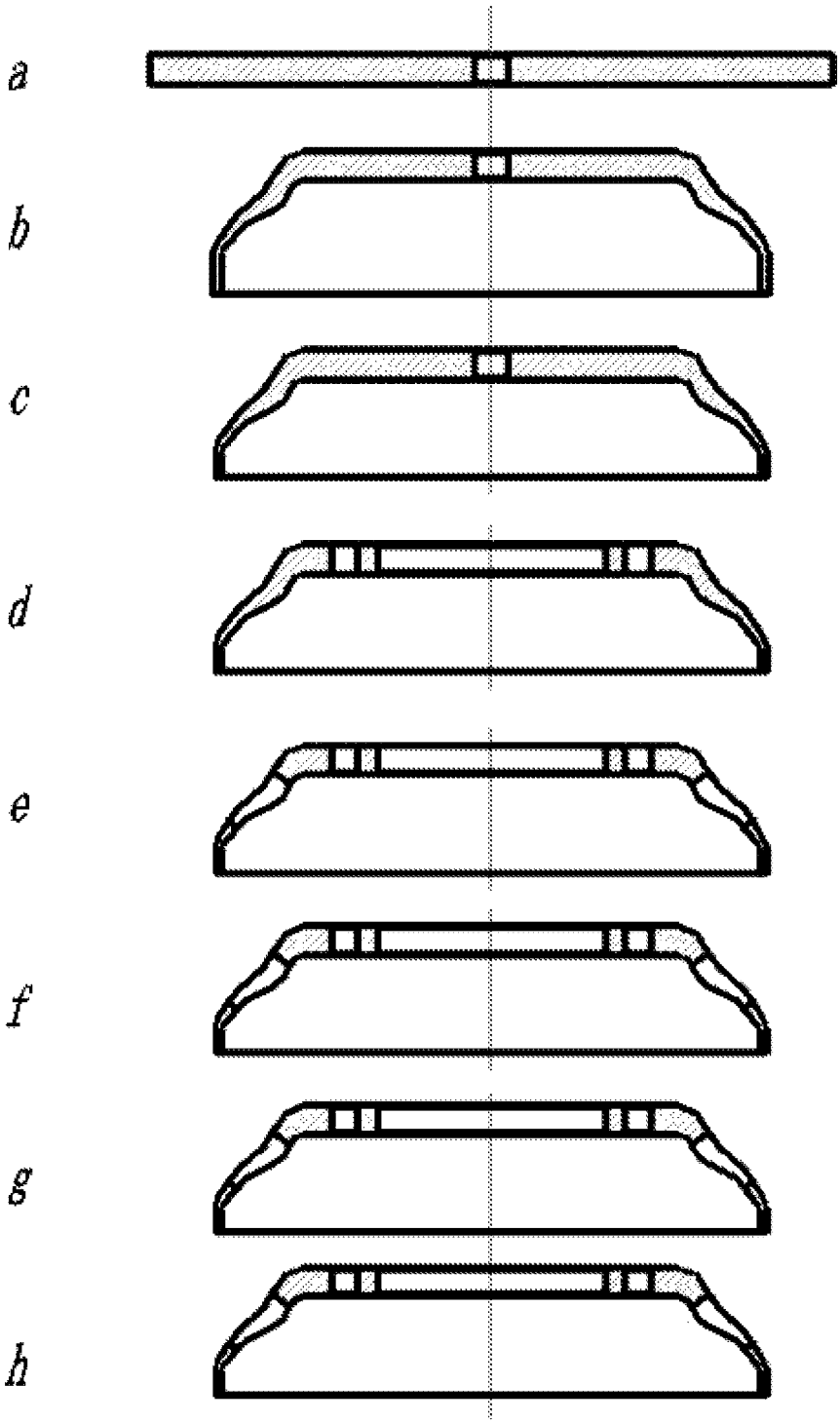
Figure 1 Prior Art
FIG. 1 is a schematic diagram of the spinning process of the wheel disc.
Figure 2:
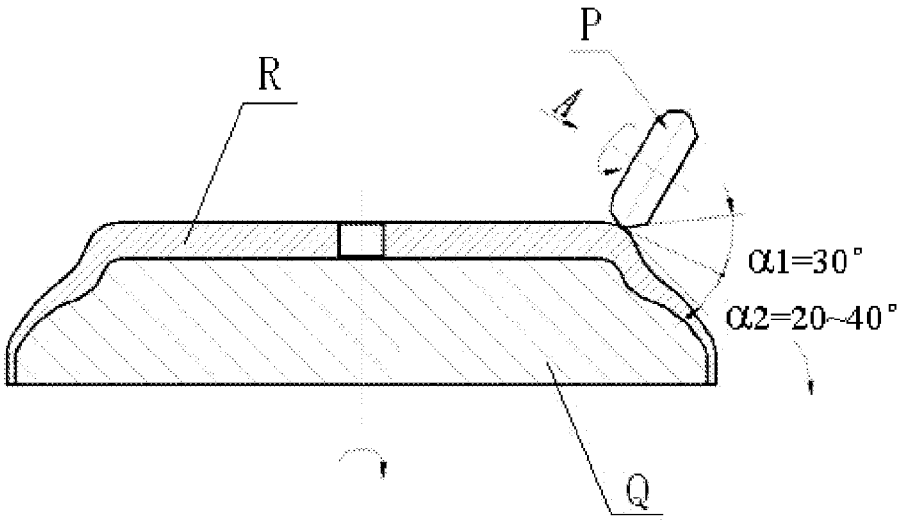
Figure 2 Prior Art
FIG. 2 is a schematic diagram of spinning motion state.
Figure 3:
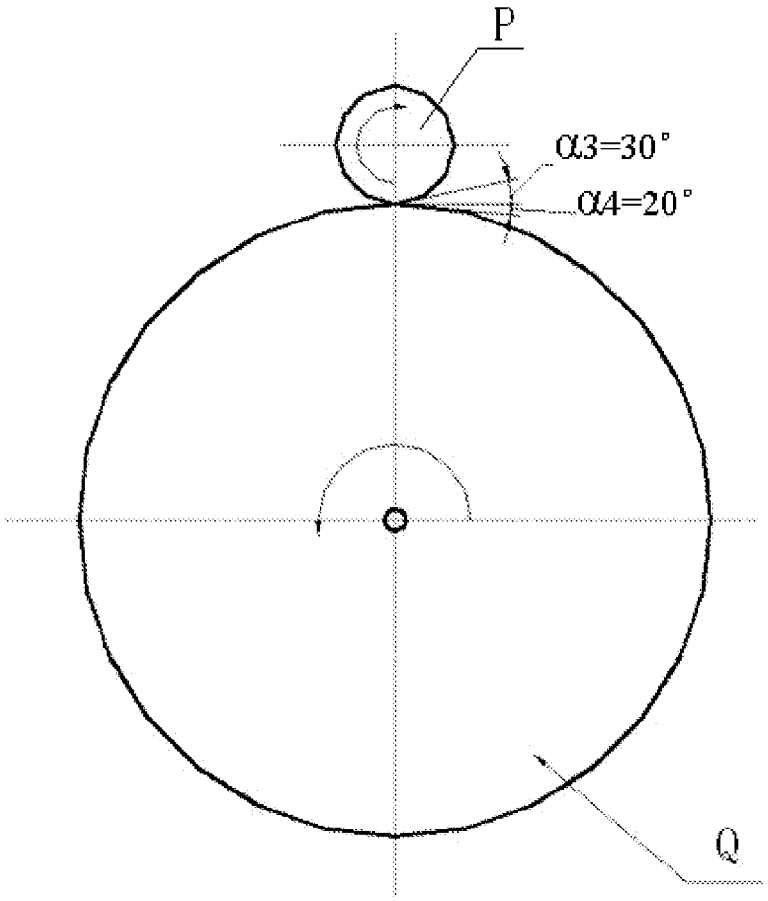
Figure 3 Prior Art
FIG. 3 is a view of FIG. 2 from the A-direction.

R circular blank
1 frame
11 base
12 column
13 upper box
2 lower rotating head assembly
3 actuating mechanism of lower rotating head assembly (hydraulic motor)
4 rolling explorator
41 cavity
42 center hole
5 rolling wheel unit
51 rolling wheel
52 sliding block
53 rotating shaft
6 upper rotating head assembly
7 feed mechanism of upper rotating head assembly (hydraulic cylinder assembly)
8 rolling wheel feeding mechanism
81 hydraulic cylinder
82 connector
821 threaded hole
83 positioning bolt
9 hydraulic motor of rolling wheel
10 cross beam
101 sliding slot
102 column hole
103 center hole of cross beam
104 side hole

DETAILED DESCRIPTION OF THE PREFERRED EMBODIMENTS

The present invention will become more fully understood from the following detail description and the accompanying figures.

Figure 4:
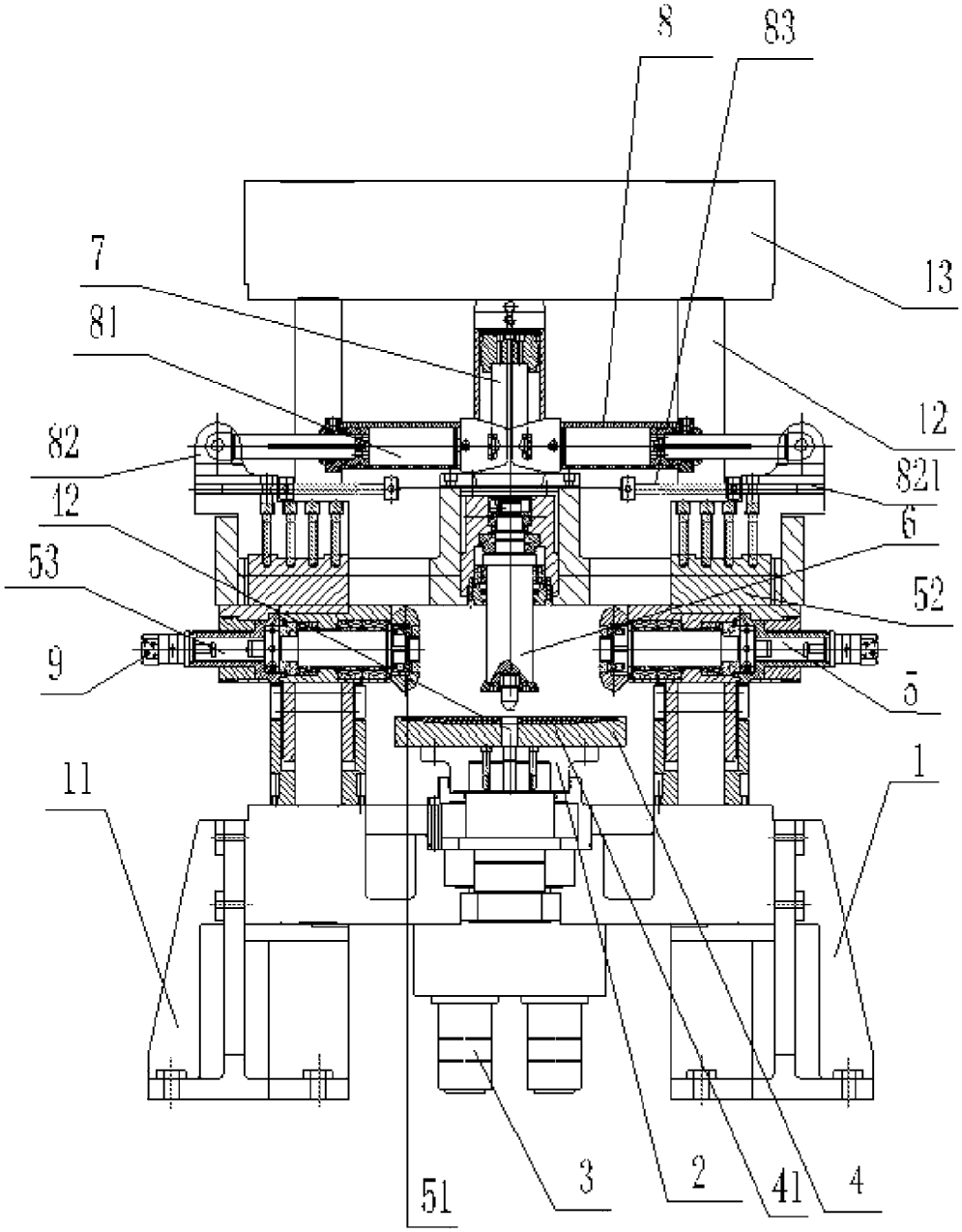
FIG. 4 is a schematic diagram of the structure of rolling forming machine adopted in an embodiment of the invention.
Figure 5:
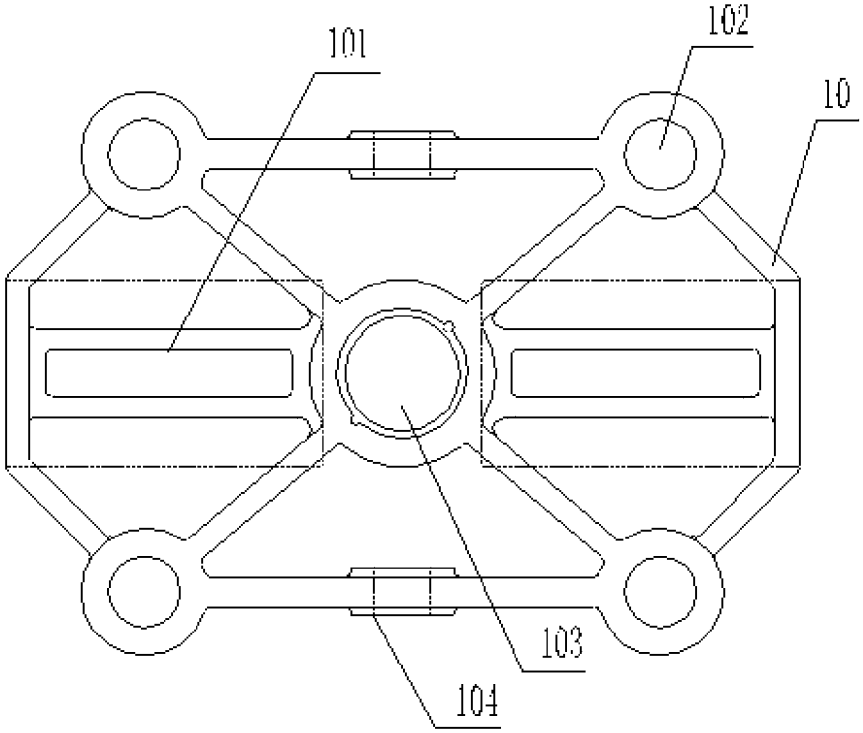
FIG. 5 shows the structure of the cross beam of the rolling forming machine adopted in an embodiment of the invention.

A rolling forming machine shown in FIG. 4 and FIG. 5 is adopted for rolling forming in this embodiment. The rolling forming machine comprises a frame 1 which is configured as a support structure of the whole rolling forming machine. The frame 1 comprises a base 11, four columns 12 symmetrically vertically mounted on the base 11 and an upper box 13 fixed on the upper ends of four columns. The rolling forming machine further comprises a lower rotating head assembly 2 fixed on the base 11 of the frame 1; an actuating mechanism of lower rotating head assembly 3 (hydraulic motor) coupled to the lower rotating head assembly 2; a disc-like rolling explorator 4 with a cavity 41 having a center hole 42 at its center area, wherein the bottom of rolling explorator 4 is fixedly connected with the lower rotating head assembly 2; an upper rotating head assembly 6 connected with a feed mechanism of the upper rotating head assembly 7 (In this embodiment, the feed mechanism of the upper rotating head assembly 7 is a pair of hydraulic cylinders); two rolling wheel units 5 symmetrically arranged along the circumferential direction of the rolling explorator 4, wherein each rolling wheel unit 5 comprises a rolling wheel 51, a rotating shaft 53 coupled to the rolling wheel 51 and arranged in a hollow sliding block 52 thereby coupled to a rolling wheel feeding mechanism 8 through the sliding block 52; a spray cooling device; and a hydraulic motor 9 of the rolling wheel correspondingly connected with the rotating shaft 53 (the hydraulic motor 9 of the rolling wheel is arranged as the rolling wheel driving element); Two rolling wheel feeding mechanisms 8 correspondingly connected with two rolling wheel units 5 so as to drive two rolling wheel 51 to move horizontally and synchronously, and vertically connected with the feed mechanism of the upper rotating head assembly 7, wherein each rolling wheel feeding mechanism 8 comprises a hydraulic cylinder 81 vertically fixed to the feed mechanism of the upper rotating head assembly 7, a connector 82 with a horizontally arranged threaded hole 821 coupled to a positioning bolt 83 for positioning the horizontal position of the rolling wheel unit 5, wherein one end of the connector 82 is fixedly connected with the piston rod of the hydraulic cylinder 81 and the other end of the connector 82 is fixedly connected with each sliding block 52 through screws respectively in order to connect the sliding block 52 to the hydraulic cylinder 81.

A cross beam 10 is arranged between the upper rotating head assembly and the feed mechanism of the upper rotating head assembly. All the rolling wheel feeding mechanisms are arranged above it. The cross beam 10 has two horizontally arranged sliding slots 101, and the sliding blocks of the rolling wheel units slide along the sliding slots 101 respectively. The sliding slots 101 and the corresponding sliding blocks can well guide the motion of the rolling wheels in the horizontal direction so as to make the horizontal feed trajectories of the rolling wheels more precise and more stable. The cross beam 10 has four column holes 102 used for arranging the cross beam 10 onto the columns. A center hole 103 on the cross beam 10 is used for arranging the upper rotating head assembly. A side holes 104 on the cross beam 10 is used for arranging one pair of the hydraulic cylinders acting as the feed mechanism of the upper rotating head assembly.

The feed mechanism of the upper rotating head assembly 7, the actuating mechanism of lower rotating head assembly 3, each rolling wheel feeding mechanism 8, the spray cooling device and the hydraulic motor 9 of rolling wheel are connected with and controlled by an electric control system respectively. The electric control system comprises a plurality of displacement sensors correspondingly arranged on the feed mechanism of the upper rotating head assembly and each rolling wheel feeding mechanism respectively; a control PLC (programmable logic controller) connected with each displacement sensors respectively for performing data exchange with all of the displacement sensors; a plurality of proportional valves connecting the control PLC and correspondingly connected with the feed mechanism of the upper rotating head assembly and each rolling wheel feeding mechanism respectively for correspondingly controlling the feed rate of the feed mechanism of the upper rotating head assembly and each rolling wheel feeding mechanism respectively.

The electric control system can adjust the feed amount and the feed rate of the upper rotating head assembly depending on the factors such as the thickness of the circular blank, in order to ensure the compaction of the circular blank. And the electric control system can further precisely control the horizontal feed rate and the horizontal feed amount of each rolling wheel during the rolling process in order to further control the circular blank to deform steady according to the precision requirements of the product and enable the shape of the formed variable section to meet the requirements of dimensional precision.

The working process of the rolling forming machine is as follows:

1) Loading: Positioning the circular blank into the cavity of the rolling explorator.

2) The feed mechanism of the upper rotating head assembly is driving the upper rotating head assembly to feed towards the circular blank in order to compress it and is driving the rolling wheel units to descend synchronously under the control of the electric control system.

3) The actuating mechanism of the lower rotating head assembly drives the lower rotating head assembly to rotate and simultaneously drives the rolling explorator and the circular blank to rotate together under the control of the electric control system, thus the upper rotating head assembly rotates together with the circular blank.

4) The rolling wheel driving element imparts an initial rotational speed to each rolling wheel under the control of the electric control system, and the rolling wheel feeding mechanism simultaneously drive each rolling wheel unit to feed horizontally under the control of the electric control system, so as to enable the rolling wheel unit to slowly enter into the space above the circular blank for rolling, wherein the initial feed amounts of the rolling wheels in the horizontal direction are staggered arranged, that is the initial rolling trajectories of the at least two rolling wheels on the surface of the circular blank are not coincident. However, the feed increments are synchronous and constant during the whole rolling process. Such process will produce a high-quality rolled workpiece with a fine grained surface.

5) The feed mechanism of the upper rotating head assembly drives the upper rotating head assembly to depart from the wheel disc blank and drive the rolling wheel units to ascend simultaneously under the control of the electric control system. The electric control system further controls the lower rotating head assembly to stop rotating.

It should be understood that the rolling forming machine described above is merely an equipment for performance the rolling actions of the rolling wheels in the step (2), and it should not be considered as the limitations on the rolling forming method of the invention.

Figure 6:
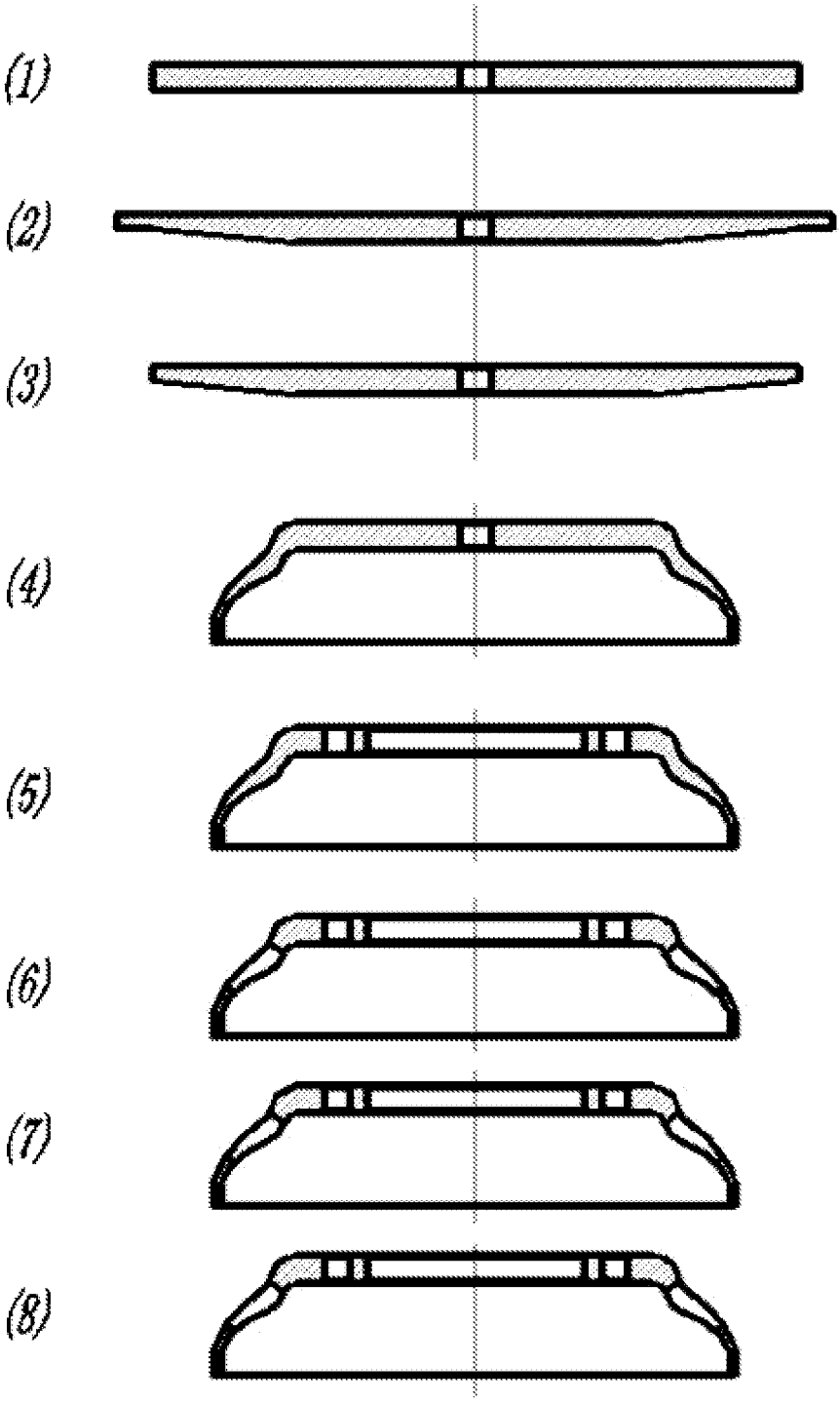
FIG. 6 is a schematic diagram of the rolling forming process of the invention.

The steps of the rolling forming method of wheel disc in this embodiment are shown in FIG. 6:

(1) Baiting a circular blank and punching a center hole at the center of the circular blank.

Figure 7:
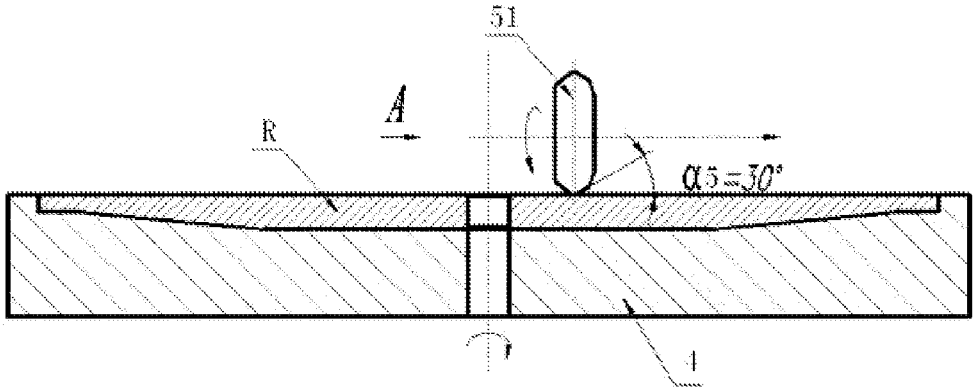
FIG. 7 is a schematic diagram of rolling motion state.
Figure 8:
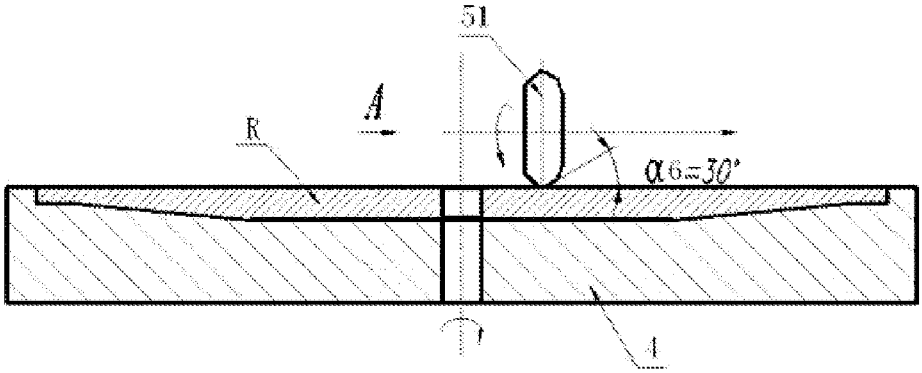
FIG. 8 is a view of FIG. 7 from the A-direction.

(2) Positioning the circular blank with the centre hole, and the rolling wheels starting rolling on the plane of the circular blank. The rolling angle $\alpha$5 shown in FIG. 7 and the rolling griping angle $\alpha$6 shown in FIG. 8 are constant during the rolling process. Two rolling wheels 51 are symmetrically arranged above the processing plane of the circular blank R along the circumferential direction of the rolling explorator 4. Rolling the circular blank R into a wheel disc blank with the rolling wheels 51 in the cavity of the rolling explorator in order to make the wheel disc blank gradually become thinner from the centre to the rim. The rolling process is described as above.

The cavity of the rolling explorator can be formed into various shapes depending on the shapes of workpieces in order to meet various demanding requirements.

Figure 9:
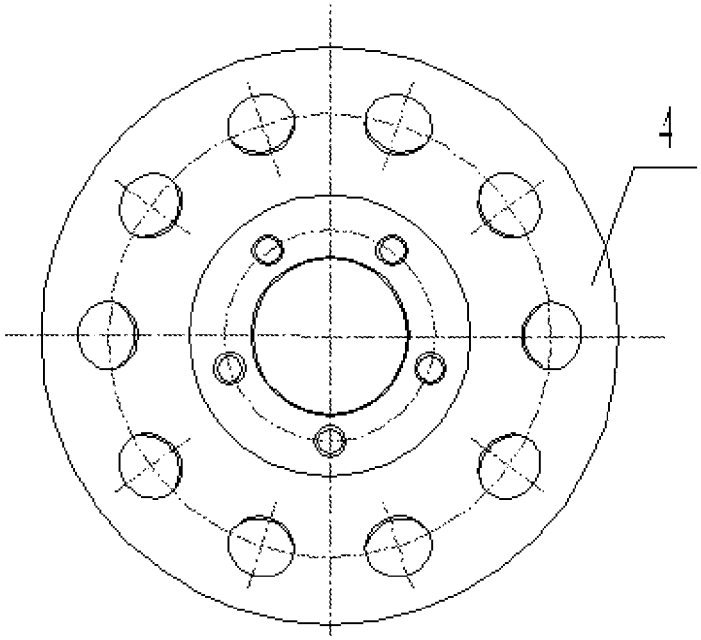
FIG. 9 shows a top view of the cavity of rolling explorator in one shape in the invention.

FIG. 9 shows a top view of the cavity of rolling explorator 4 in one shape. The salient circles shown in the figure are for the circular holes on the wheel disc. Placing the circular blank into the cavity shown in the figure and rolling the upper surface of the circular blank with the rolling wheels. The salient parts of the rolled circular blank are very thin, hence the holes on the wheel disc can be formed by lightly knocking off or punching the salient parts merely, which is quite simple and convenient.

Figure 10:
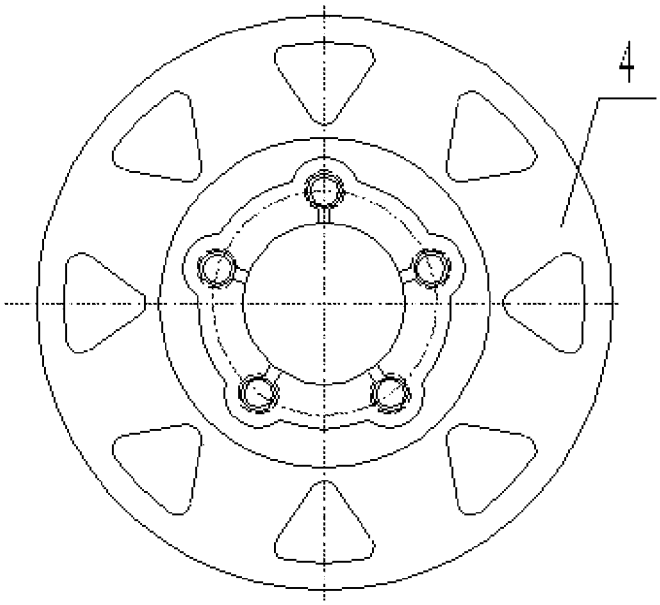
FIG. 10 is a top view of the cavity of rolling explorator in another shape in the invention.

FIG. 10 shows a top view of the cavity of rolling explorator 4 in another shape.

Figure 11:
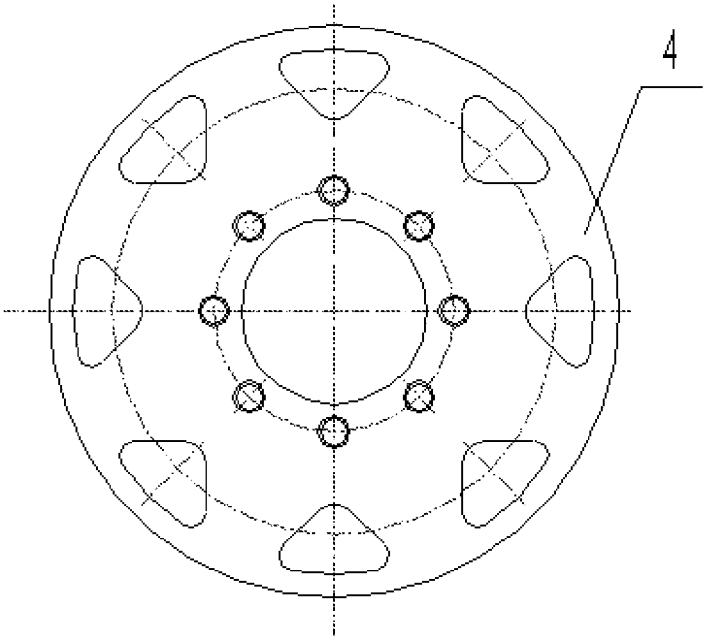
FIG. 11 is a top view of the cavity of rolling explorator in further another shape in the invention.

FIG. 11 shows a top view of the cavity of rolling explorator 4 in further another shape. It can be seen that the shape of the cavity of the rolling explorator 4 can be changed depending on the desired shape of the workpiece from FIG. 9 to FIG. 11. It should be understood that the shapes of the cavity of the rolling explorator in the invention could be various, and the shapes shown in FIG. 9 to FIG. 11 are merely three embodiments which can not be considered as the limitations on the invention.

After rolling forming process described above, the wheel disc blank has a uniform mass along the circumferential direction and has a high dynamic balance precision, so the outer circle of the wheel disc blank does not need to be further processed on a vertical lathe. The precision of the end surface of the outer circle can be ensured by moulds, as long as following steps will be performed:

(3) Performing trimming and sizing on the wheel disc blank in a blanking method.

(4) Stretching the wheel disc blank in dwell method with a blank holder.

(5) Blanking the center hole and screw holes.

(6) Blanking hand holes and then extruding them.

(7) Reaming the spherical surface of the screw holes.

(8) Turning the center hole.

As shown in FIG. 2, FIG. 3, FIG. 7 and FIG. 8, the forming forces, the deformation ways of the blanks and the results are different between the rolling forming method of the invention and the spinning forming method. The spinning deformation force, which makes the blank stretch in the forming process of the wheel disc, is smaller than the rolling deformation force. During the rolling forming process, the stress area of the blank is larger, the force is stronger and the blank is extruded in the explorator, which generates a yield deformation of the blank. The reason for that the deformation forces are different between the rolling forming method and the spinning forming method is that the angles in these two forming ways are different. The rolling angle $\alpha$5 is smaller than the spinning angle ($\alpha$1+$\alpha$2) (the smaller the angle, the stronger the force), and the rolling gripping angle $\alpha$6 (i.e. the gripping angle of the rolling wheel 51) of the rolling wheel 51 is smaller than the spinning gripping angle ($\alpha$3+$\alpha$4) of the spinning wheel (the smaller the rolling gripping angle, the stronger the extruding force), therefore the rolling force in the invention is much stronger than the spinning force.

The inventor adopts the rolling forming method of the invention to form wheel disc products with 380 material, and then performs bending fatigue tests on the wheel disc products. The results of the bending fatigue tests show that cracks occur in the wheel disc products (i.e. the wheel disc products are damaged) after above 1.5 million tests, and the wheel disc products are still intact after 1.2 million tests.

In order to contrast with the effect of rolling forming method of the invention, the inventor also adopts the spinning forming method to form wheel disc products with 380 material, and then also performs bending fatigue tests on the wheel disc products. The results of the bending fatigue tests show that the wheel disc products are generally damaged after about 1 million tests.

It can be seen that the rolling forming method of the invention is shorter in processing time, higher in production efficiency, higher in product precision and larger in bending fatigue strength comparing with the existing spinning forming method.

The above description is merely embodiments in nature and is in no way intended to limit the invention, its application, or use.

What is claimed is:

1. A forming method of a wheel disc, comprising the following steps:

(1) forming a circular blank;

(2) placing the circular blank in a cavity of a circular rolling explorator;

(3) rolling the circular blank into a wheel disc blank which gradually becomes thinner from the center to the rim by performing synchronous staggered rolling on the circular blank in the cavity of the explorator using at least two rolling wheels symmetrically arranged along the circumferential direction of the rolling explorator;

(4) trimming and sizing the wheel disc blank; and (5) stretching the wheel disc blank to form a wheel disc to meet shape requirements of a section of the wheel disc and dimensional requirements of an outer diameter and a height of the wheel disc.

2. The forming method of the wheel disc according to claim 1, wherein rolling motions of the at least two rolling wheels in the step (3) comprise feed motions of the at least two rolling wheels in a horizontal direction and a rotation of each rolling wheel.

3. The forming method of the wheel disc according to claim 2, wherein the feed motion of each rolling wheel in the step (3) is controlled by a rolling wheel feeding mechanism connected with an electric control system, wherein the electric control system controls a feed rate and a feed amount of each rolling wheel feeding mechanism respectively thereby to further control the feed rate and the feed amount of each rolling wheel.

4. The forming method of the wheel disc according to claim 2, wherein the rotation of each rolling wheel in the step (3) is driven by a rolling wheel driving element connected with each rolling wheel respectively, and each rolling wheel driving element is connected with and controlled by an electric control system.

5. The forming method of the wheel disc according to claim 1, further comprising the step (6): processing a center hole, screw holes, hand holes and spherical surfaces of the screw holes on the formed wheel disc.

6. The forming method of the wheel disc according to claim 5, wherein a section of the cavity of the rolling explorator adopted in the step (2) is an equal strength section, and a shape of the cavity of the rolling explorator corresponds to a shape of the wheel disc.

7. The forming method of the wheel disc according to claim 6, wherein, in the step (1), the center hole is punched on the circular blank to position the circular blank in the cavity of the rolling explorator after cutting the circular blank.

8. The forming method of the wheel disc according to claim 7, wherein, in the step (4), trimming and sizing the wheel disc blank comprises a blanking method.

9. The forming method of the wheel disc according to claim 6, wherein, in the step (5), stretching the wheel disc blank comprises a dwell method to make the outer diameter of the formed wheel disc precise.

10. The forming method of the wheel disc according to claim 2, further comprising a step (6): processing a center hole, screw holes, hand holes and spherical surfaces of the screw holes on the formed wheel disc.

11. The forming method of the wheel disc according to claim 7, wherein, in the step (5), stretching the wheel disc blank comprises a dwell method to make the outer diameter of the formed wheel disc precise.

12. The forming method of the wheel disc according to claim 1, wherein the step (3) is implemented by a rolling forming machine, comprising:

a frame configured as a support structure of the whole rolling forming machine;

a lower rotating head assembly fixed on the frame;

an actuating mechanism of the lower rotating head assembly connected with the lower rotating head assembly;

an electric control system connected with the actuating mechanism of the lower rotating head assembly;

a disc-like rolling explorator, the bottom of which is fixed to the lower rotating head assembly, having a cavity which could be formed into various shapes depending on the shapes of workpieces to be machined;

at least two rolling wheel units symmetrically arranged along the circumferential direction of the rolling explorator, wherein each rolling wheel unit comprises a rolling wheel which performs rolling motions in the cavity; the number of the rolling wheel unit can also be three, four or even more; and the symmetrical arrangement of the rolling wheels balances an unbalanced radial force generated during a rolling deformation process of the workpieces;

an upper rotating head assembly connected with a feed mechanism of the upper rotating head assembly to compress the rolling explorator under a drive of the feed mechanism of the upper rotating head assembly connected with the electric control system; and at least two rolling wheel feeding mechanisms correspondingly connected with the rolling wheel units and vertically connected with the feed mechanism of the upper rotating head assembly to drive horizontal synchronous motions of the rolling wheels under the control of the electric control system.

13. The forming method of the wheel disc according to claim 12, further comprising a cross beam with at least two horizontally arranged sliding slots arranged between the upper rotating head assembly and the feed mechanism of the upper rotating head assembly and wherein the rolling wheel feeding mechanisms are arranged over the cross beam.

14. The rolling forming method of the wheel disc according to claim 12, wherein the frame comprises:

a base, on which the lower rotating head assembly is fixedly mounted;

at least four columns symmetrically vertically arranged on the base; and an upper box fixed on the upper ends of all the columns and coupled to the feed mechanism of the upper rotating head assembly.

15. The forming method of the wheel disc according to claim 12, wherein each rolling wheel feeding mechanism comprises:

a hydraulic cylinder fixed to the feed mechanism of the upper rotating head assembly vertically; and a connector with a horizontally arranged threaded hole coupled to a positioning bolt, wherein one end of the connector is fixed to a piston rod of the hydraulic cylinder, the other end of the connector is fixed to a sliding block correspondingly, and the threaded hole and the corresponding positioning bolt are used for positioning a horizontal position of the rolling wheel unit.

16. The forming method of the wheel disc according to claim 12, wherein the feed mechanism of the upper rotating head assembly is a hydraulic cylinder assembly.

17. The forming method of the wheel disc according to claim 12, wherein the actuating mechanism of the lower rotating head assembly is a hydraulic motor.

18. The forming method of the wheel disc according to claim 12, wherein each rolling wheel unit further comprises a spray cooling device which is connected with the electronic control system.

19. The forming method of the wheel disc according to claim 12, wherein the electric control system comprises:

a plurality of displacement sensors correspondingly arranged on the feed mechanism of the upper rotating head assembly and each rolling wheel feeding mechanism respectively;

a programmable logic controller (PLC) connected with each displacement sensors respectively for performing data exchange with all of the displacement sensors; and a plurality of proportional valves connected with the PLC and correspondingly connected with the feed mechanism of the upper rotating head assembly and each rolling wheel feeding mechanism respectively for correspondingly controlling a feed rate of the feed mechanism of the upper rotating head assembly and each rolling wheel feeding mechanism, respectively.

20. The forming method of the wheel disc according to claim 12, wherein each rolling wheel unit further comprises:

a hollow sliding block correspondingly fixed to each rolling wheel feeding mechanism; and a rotating shaft arranged in the hollow sliding block, wherein one end of the rotating shaft is correspondingly connected with each rolling wheel respectively and the other end of the rotating shaft is correspondingly coupled to a rolling wheel motor.

* * * * *